US005315811A

United States Patent [19]

Biesecker et al.

[11] Patent Number: 5,315,811

[45] Date of Patent: May 31, 1994

[54] METHOD OF PACKAGING WITH AN OUTER CONTAINER HAVING A CONTAINER INSERT FOR HOLDING A PREDETERMINED VOLUME OF MATERIAL

[75] Inventors: Lissa B. Biesecker, Boyertown; Glenn J. Forte, Coatesville; Justin P. Boyle, Audobon; Norris W. Matthews, Stowe, all of Pa.

[73] Assignee: Drug Plastics & Glass Company, Inc., Boyertown, Pa.

[21] Appl. No.: 959,513

[22] Filed: Oct. 13, 1992

Related U.S. Application Data

[60] Continuation of Ser. No. 756,409, Sep. 9, 1991, abandoned, which is a division of Ser. No. 707,489, May 30, 1991, Pat. No. 5,197,602.

[51] Int. Cl.[5] ..... B65B 5/00

[52] U.S. Cl. ..... 53/474; 53/410; 53/449; 53/452

[58] Field of Search ..... 53/410, 449, 452, 467, 53/470, 474, 472, 503

[56] References Cited

U.S. PATENT DOCUMENTS

| | | | |
|---|---|---|---|
| Re. 23,434 | 11/1951 | Numbers | 222/114 |
| 1,657,168 | 1/1928 | Marrian | 222/584 |
| 2,897,641 | 8/1959 | Simon et al. | 53/472 X |
| 2,938,518 | 5/1960 | Horrocks | 128/272 |
| 3,163,544 | 12/1964 | Valyi | 99/171 |
| 3,450,254 | 6/1969 | Miles | 206/46 |
| 3,458,076 | 7/1969 | Babcock | 215/6 |
| 3,484,011 | 12/1969 | Greenhalgh et al. | 215/12 |
| 3,667,593 | 6/1972 | Pendleton | 53/472 X |
| 3,733,771 | 5/1973 | Megowen | 53/37 |
| 3,807,955 | 4/1974 | Note, Jr. et al. | 23/230 B |
| 4,459,793 | 7/1984 | Zenger | 53/449 X |
| 4,460,090 | 7/1984 | Paoletti | 206/540 |
| 4,658,989 | 4/1987 | Bonerb | 53/449 X |
| 4,782,945 | 11/1988 | Geiler et al. | 206/203 |
| 4,846,359 | 7/1989 | Baird et al. | 215/12.2 |
| 4,862,674 | 9/1989 | Lejondahl et al. | 53/472 X |
| 4,873,193 | 10/1989 | Jensen et al. | 436/176 |
| 5,099,998 | 3/1992 | Curzon et al. | 206/514 |
| 5,219,005 | 6/1993 | Stoffel | 141/3 |

FOREIGN PATENT DOCUMENTS

| | | |
|---|---|---|
| 447803 | 7/1927 | Fed. Rep. of Germany . |
| 474612 | 9/1952 | Italy . |
| 3210 | of 1913 | United Kingdom . |
| 1432005 | 4/1976 | United Kingdom . |

*Primary Examiner*—John Sipos
*Assistant Examiner*—Daniel Moon
*Attorney, Agent, or Firm*—Panitch Schwarze Jacobs & Nadel

[57] ABSTRACT

System of packaging with an outer container having a container insert therein for holding a predetermined volume of material. The outer container includes a container bottom having a periphery and a container wall extending generally upwardly to define an interior container portion of predetermined volume sized to accommodate the container insert. The container wall includes a neck portion complementarily sized to accommodate the exterior surface of the container insert. The container insert includes a bottom having a periphery and a wall extending generally upwardly to define an interior portion of predetermined volume for holding the material. The insert wall includes a vent which allows air to pass from the interior container portion to the atmosphere when the container insert is positioned therein. For assembly, the outer container is maintained at a temperature greater than the container insert and the container insert is positioned therein. The outer container is cooled such that the interior surface of the neck portion of the outer container contracts into engagement with the exterior surface of the upper portion of the container insert.

1 Claim, 3 Drawing Sheets

METHOD OF PACKAGING WITH AN OUTER CONTAINER HAVING A CONTAINER INSERT FOR HOLDING A PREDETERMINED VOLUME OF MATERIAL

This is a continuation application of Ser. No. 07/756,409, filed Sep. 9, 1991, now abandoned, which is a division of application Ser. No. 07/707,489, filed May 30, 1991 now U.S. Pat. No. 5,197,602.

FIELD OF THE INVENTION

The invention relates to packaging a predetermined volume of material and, more particularly, to a container insert for holding a predetermined volume of material within an outer container, a method for assembly thereof and a method for packaging a predetermined volume of material by use of such a container.

BACKGROUND OF THE INVENTION

In order to decrease the cost and increase the efficiency of packaging materials, it would be useful to have containers of uniform outer dimensions which allow for packaging of different predetermined volumes of material. For example, a typical pharmaceutical manufacturer may package different quantities of a product for shipment to retail pharmacies in correspondingly sized different containers. The manufacturer may decide to ship a product in two or three different quantities (e.g., 50 or 200 tablets) in two or three different sized containers. The tablets to be shipped may contain different dosages of medication (e.g., 30 mg, 100 mg, etc.). The pills may be sized or shaped differently. Each of these factors, and other factors too numerous to mention, may affect the volume of material to be packaged in an individual bottle. A manufacturer may, therefore, need a series of bottles having different interior volumes to accommodate the disparate volumes of material to be packaged. Each series of bottles may have different exterior dimensions and configurations, thereby requiring different equipment lines for packaging and labelling the bottles.

It would be advantageous for a manufacturer to have available containers of uniform outer dimension and configuration in order to standardize systems for filling, closing, and labelling each bottle and rendering tamperproof the bottle closures. The size of dispensing and shipping cartons and the packaging system therefor may also be standardized.

In addition, it would be advantageous for a manufacturer to have available a container at least partially formed from recycled materials in order to lessen container cost and to help preserve the environment. However, in areas where contamination of the packaged material is of concern, it is desirable that the recycled portion of the container not contact the packaged material. Contamination of the packaged material is particularly undesirable in the pharmaceutical industry, where product purity is imperative. The present invention fulfills a long-felt need in the art by overcoming the aforementioned disadvantages of the prior art containers and providing other advantages as set forth below.

SUMMARY OF THE INVENTION

Briefly stated, the present invention comprises a container insert for holding a predetermined volume of material and for being positioned within an outer container. The outer container comprises a container bottom having a periphery and a container wall extending generally upwardly from the periphery. The container bottom and container wall define an interior container portion having a predetermined volume. The interior container portion is sized to accommodate the container insert. The container wall comprises a neck portion defining an opening for receiving the container insert therein. The neck portion has an interior surface complementarily sized to accommodate an exterior surface of the container insert for securely fixing the container insert within the interior container portion. The container insert comprises a bottom having a periphery and a wall extending generally upwardly from the periphery. The bottom and the wall define an interior portion of predetermined volume for holding the predetermined volume of material. The predetermined volume of the interior portion of the insert is less than the predetermined volume of the interior container portion. The wall comprises an upper portion having an exterior surface for being in engagement with the interior surface of the neck portion. The insert includes vent means for allowing fluid to pass from the interior container portion to the atmosphere when the container insert is positioned within the outer container.

A further aspect of the present invention is a method for assembling an outer container having a container insert. The method comprises the steps of forming an outer container comprising a container bottom having a periphery and a container wall extending generally upwardly from the periphery. The container bottom and the container wall define an interior container portion which has a predetermined volume and is sized to accommodate a container insert. The container wall comprises a neck portion which defines an opening for receiving the container insert therein. The neck portion has an interior surface complementarily sized to accommodate an exterior surface of the container insert for securely fixing the container insert within the interior container portion. The method further comprises forming a container insert including a bottom having a periphery and a wall extending generally upwardly from the periphery. The bottom and the wall define an interior portion of predetermined volume for holding the predetermined volume of material. The predetermined volume of the interior portion of the container insert is less than the predetermined volume of the interior container portion. The wall comprises an upper portion spaced apart from the bottom. The upper portion has an exterior surface for being placed in engagement with the interior surface of the neck portion. The insert includes vent means for allowing fluid to pass from the interior container portion to said atmosphere when the container insert is positioned within the outer container. The temperature of the container insert is controlled such that the container insert is at a first predetermined temperature. The temperature of the outer container is controlled such that the outer container is at a second predetermined temperature greater than the first predetermined temperature of the container insert. The container insert is positioned through the opening in the neck portion into the interior container portion of the outer container such that the exterior surface of the upper portion is in facing relationship with the interior surface of the neck portion and the vent means is in fluid communication with the atmosphere surrounding the outer container and the interior container portion for allowing fluid to pass through the vent means from the interior container portion to the atmosphere. The outer container is then cooled to a third predetermined temperature less than the second predetermined temperature such that the interior surface of the neck portion contracts into engagement with the exterior surface of the upper portion of the container insert, whereby the container insert is frictionally secured to the neck portion.

Another aspect of the present invention is a method for packaging a predetermined volume of material, comprising the steps of determining the predetermined volume of material to be packaged and selecting an outer container having a volume greater than the predetermined volume of material to be packaged and a container insert therein having an interior portion of a predetermined volume from a group of outer containers with container inserts therein having predetermined volumes different than the volume of material to be packaged. The material is then inserted into the interior portion of the container insert.

BRIEF DESCRIPTION OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF PREFERRED EMBODIMENTS

Figure 1:
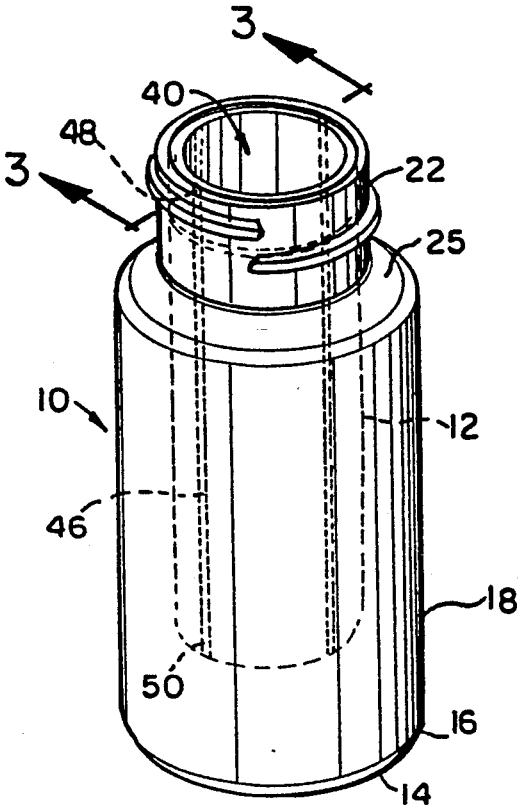
FIG. 1 is a perspective view of an outer container having a container insert in accordance with a first embodiment of the present invention therein.
Figure 2:
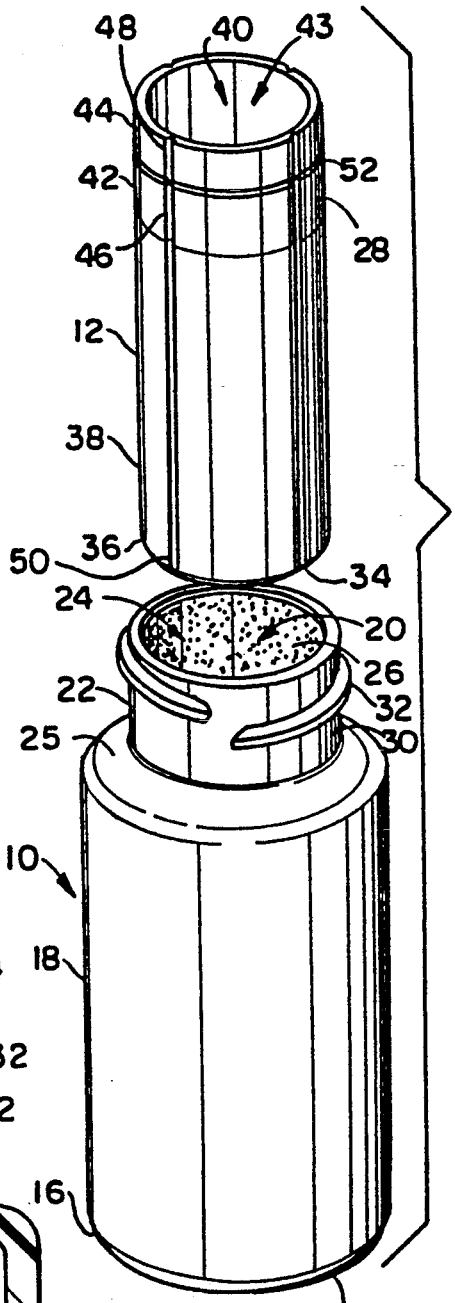
FIG. 2 is an exploded perspective view of the container insert of FIG. 1.
Figure 3:
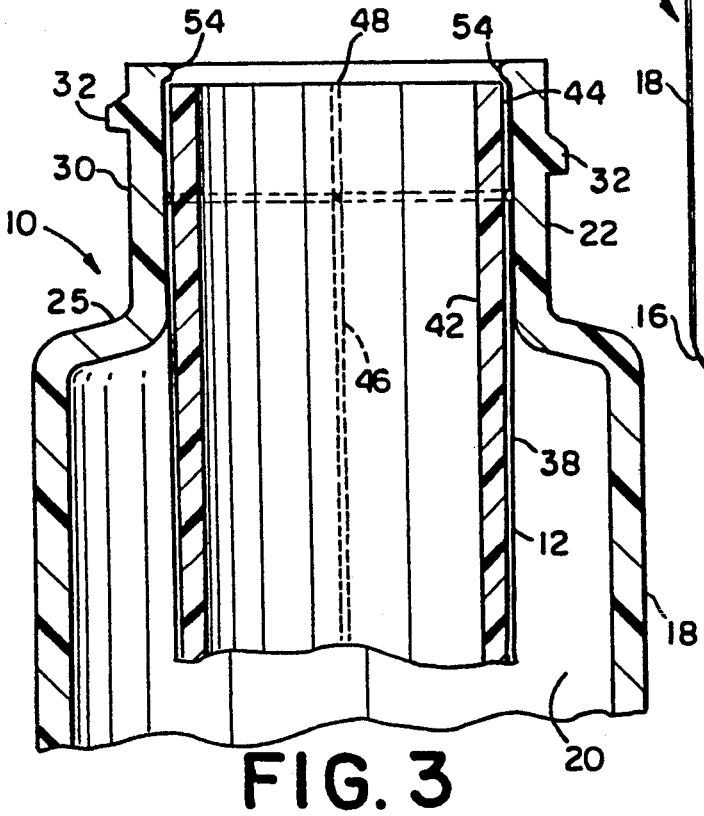
FIG. 3 is a cross-sectional view of the outer container and container insert of FIG. 1 taken along lines 3—3 of FIG. 1.

Referring to the drawings, wherein like numerals indicate like elements throughout, there is shown in FIGS. 1 through 3 an outer container, generally designated 10, having a container insert 12 therein for holding a predetermined volume of material (not shown), in accordance with a first embodiment of the present invention.

The outer container 10 comprises a container bottom 14 having a periphery 16 and a container wall 18 extending generally upwardly from the periphery 16. It is preferred that the container bottom 14 be generally planar, although the bottom 14 may be concave (see FIG. 4). The periphery 16 of the container bottom 14 may be slightly rounded to eliminate any sharp edges from the container 10. Preferably, the container bottom 14 and container wall 18 define an outer container 10 which is generally annular in cross section, although the outer container 10 may be of any shape such as generally rectangular in cross section, as one of ordinary skill in the art would understand.

As best shown in FIGS. 2 and 3, the container bottom 14 and the container wall 18 define an interior container portion, generally indicated at 20, having a predetermined volume. The interior container portion 20 is sized to accommodate the container insert 12, as described in more detail hereinafter. The container wall 18 comprises a neck portion 22 defining an opening, indicated generally at 24, for receiving the container insert 12 therein. Preferably, the opening 24 in the neck portion 22 is generally circular in cross section and has a diameter which is smaller than the inner diameter of the container wall 18. The neck portion 22 includes a transition surface 25 between the neck portion 22 and container wall 18. The transition surface 25 is preferably curved to eliminate sharp edges and increase structural integrity. The neck portion 22 has an interior surface 26 complementarily sized to accommodate an exterior surface 28 of the container insert 12 for securely fixing the container insert 12 within the interior container portion 20, as described in more detail hereinafter.

As best shown in FIG. 3, it is preferred that the interior surface 26 of the neck portion 22 include a lip 54 extending radially inwardly along the upper end thereof for preventing the insert 12 from being removed from the interior container portion 20. That is, the insert 12 is initially positioned within the outer container 10 with a snap fit. The lip 54 prevents the insert 12 from moving upwardly out of the outer container 10. The neck portion 22 has an exterior surface 30 which preferably includes threads 32 for receiving a cap (not shown). One skilled in the art would understand that other means besides threads 32 may be used to accommodate the cap, such as a friction fit or a child-proof fastener (not shown). In addition, any gap between the cap and the opening 24 of the neck portion 22 may be sealed by a sheet of material, such as plastic, in order to inhibit tampering, as is well known by those of ordinary skill in the art.

As best shown in FIGS. 2 and 3, the present invention further comprises a container insert 12 positioned within the interior container portion 20 of the outer container 10. The container insert 12 comprises a bottom 34 having a periphery 36 and a wall 38 extending generally upwardly from the periphery 36. Presently, it is preferred that the bottom 34 and wall 38 of the container insert 12 define a container insert 12 which is generally annular in cross section, although one skilled in the art would understand that the shape of the container insert 12 may be generally rectangular in cross section, or any other complementary shape which may be accommodated within the interior container portion 20 and neck portion 22 of the outer container 10, in keeping with the spirit and scope of the present invention.

The bottom 34 and the wall 38 of the container insert 12 define an interior portion, generally indicated at 40, of predetermined volume for holding the predetermined volume of material. The predetermined volume of the interior portion 40 of the insert 12 is less than the predetermined volume of the interior container portion 20 of the outer container 10.

As best shown in FIG. 2, the wall 38 comprises an upper portion 42 spaced apart from the bottom 34. The upper portion 42 defines an opening, indicated generally at 43, for receiving the material to be packaged. As shown in FIG. 3, the upper portion 42 has an exterior surface 44 in facing engagement with the interior surface 26 of the neck portion 22. Preferably the exterior surface 44 and interior surface 26 are securely engaged together by a friction fit, although one skilled in the art would understand that other means, such as adhesive or fasteners, may be used to maintain the surfaces 44, 26 in engagement. The surfaces 44, 26 are aligned such that the top edge of the exterior surface 44 is in engagement with the lip 54, as best shown in FIG. 3. The upper portion 42 has a height which corresponds to the height of the neck portion 22 of the outer container 10.

The container insert 12 preferably includes vent means in the exterior surface of the wall 38 for allowing fluid, such as air, to pass from the interior container portion 20 to the atmosphere when the container insert 12 is positioned within the outer container 10.

In the first embodiment, the vent means preferably includes four grooves 46 in the exterior surface of the wall 38 of the insert 12, each groove 46 having a first end 48 and a second end 50. Because of the arcuate periphery of the lip 54, the first end 48 of the grooves 46 is in fluid communication with the atmosphere surrounding the outer container 10 and the insert 12. The second end 50 of the grooves 46 is in fluid communication with the interior container portion 20 of the outer container 10 for allowing fluid, such as air, to pass through the grooves 46 from the interior container portion 20 to the atmosphere when the container insert 12 is positioned within the outer container 10.

Preferably, the second end 50 of the grooves 46 extends to the periphery 36 of the bottom 34, such that the grooves 46 extend the length of the insert 12. Therefore, as the insert 12 is positioned within the interior container portion 20, the interior container portion 20 is in continuing fluid communication with the surrounding atmosphere to allow air within the interior container portion 20 which is displaced by insertion of the insert 12 to pass to the atmosphere.

A skilled artisan understands that the grooves 46 may be of any length sufficient to span the exterior surface 44 of the upper portion 42 of the container insert 12. The width of the grooves 46 may be any width sufficient to allow the air within the interior container portion 20 to escape to the atmosphere without impeding insertion of the insert 12. However, a sufficient portion of the exterior surface 44 must remain to ensure sufficient contact between the exterior surface 44 of the upper portion 42 and interior surface 26 of the neck portion 22 to maintain the desired friction fit. One skilled in the art would understand that any number of grooves 46 may be provided in the wall 38 of the container insert 12 including one, two or six. Presently, it is preferred that the four grooves 46 be formed equidistantly around the exterior surface 44, although they may be randomly placed thereabout.

It is understood by those skilled in the art that other vent means may be provided in the container insert 12 or outer container 10 for allowing air to pass from the interior container portion 20 to the surrounding atmosphere. For instance, an opening (not shown) can extend through the wall 38 of the insert 12 or the wall 18 of the outer container 10 for allowing fluid to pass therethrough between the interior container portion 20 and the atmosphere without departing from the spirit and scope of the invention.

Preferably, at least one of the insert 12 and the outer container 10 is constructed of a thermoplastic, such as a high density polyethylene or polypropylene. For pharmaceutical applications, it is preferred that the insert 12 and outer container 10 be formed from virgin material to inhibit contamination of the material to be packaged therein. However, one skilled in the art would understand that the insert 12 and outer container 10 may be formed from any suitable material, such as glass. It is preferred that the outer container 10 be formed from an injection-blow moldable material which contracts upon cooling to ambient temperature in order to maintain the friction fit between the exterior surface 44 of the insert 12 and the interior surface 26 of the outer container 10, as described in more detail hereinafter.

Figure 4:
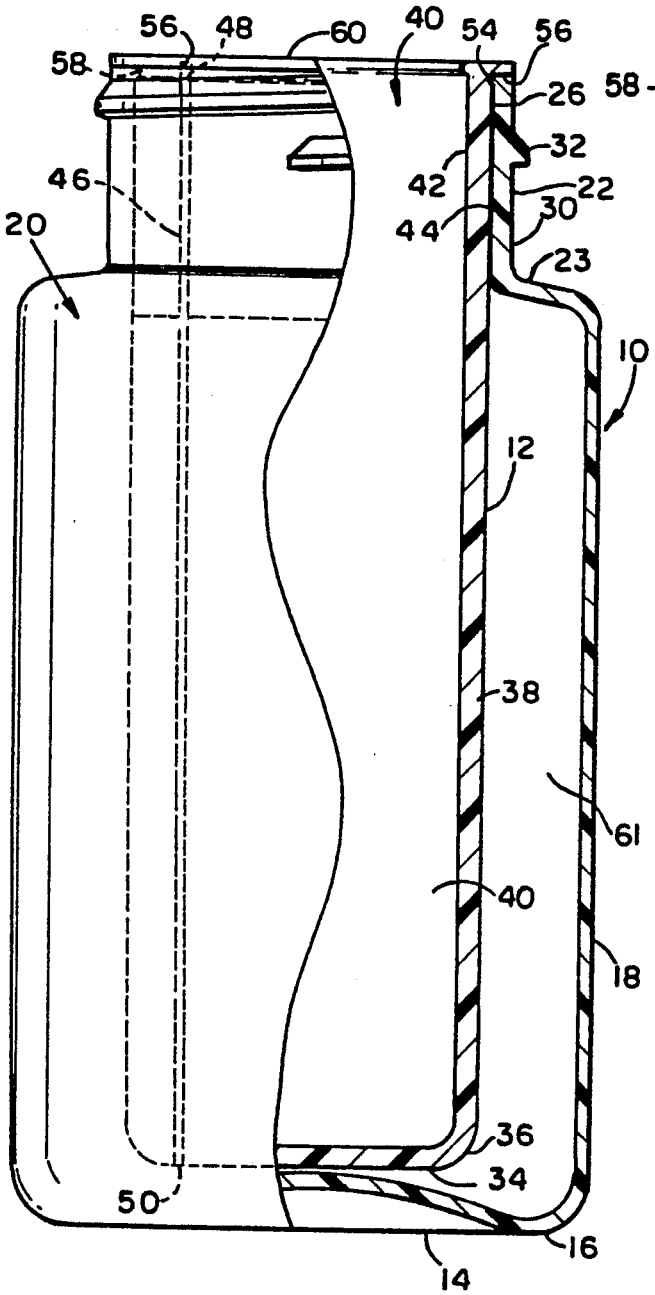
FIG. 4 is an elevational view, partially in cross section, of an outer container having a container insert in accordance with a second embodiment of the invention therein.
Figure 5:
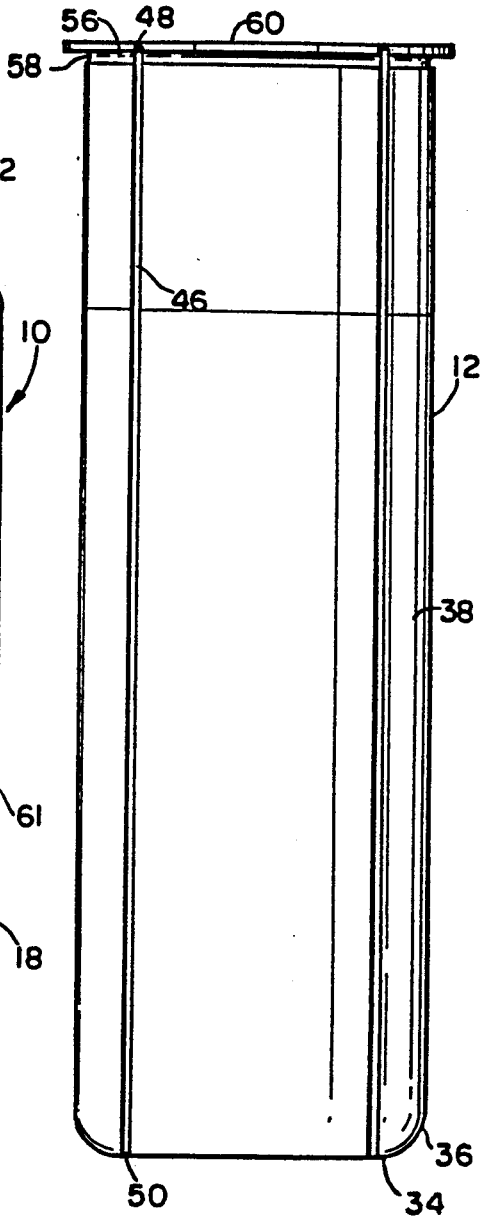
FIG. 5 is an elevational view of the container insert of FIG. 4.

Referring now to FIGS. 4 and 5, there is shown a second embodiment of an outer container 10 and container insert 12. The outer container 10 is generally identical to the outer container described above in connection with the first embodiment shown in FIGS. 1 through 3. Similarly, the container insert 12 is generally identical to the container insert 12 described above in connection with the first embodiment, except that the upper portion includes a flange 60 extending generally radially outwardly a distance sufficient to substantially overlap an upper edge 56 of the neck portion 22.

As best shown in FIG. 5, the exterior surface of the container insert 12 includes a complementary groove 58 just below the flange 60 for receiving the lip 54 of the neck portion 22 to assist in securely locking the container insert 12 within the outer container 10. In order to allow the air within the interior container portion 20 to escape to the atmosphere, the grooves 46 extend to the periphery of the flange 60.

Since the container insert 12 includes a flange 60, the material to be packaged does not contact the outer container 10 during packaging and dispensing. Therefore, in the second embodiment, it is preferred that the outer container 10 be formed from a recyclable material, such as plastic. In the pharmaceutical industry, where maintaining product purity is imperative, it is particularly desirable that the recycled portion of the container not contact the packaged material.

In the present invention, the portion of the container insert 12 which receives the material to be packaged is insulated from the outer container 10 by the wall 38 of the container insert 12 and an air barrier 61 between the container insert 12 and the outer container 10 which prevents contamination of the packaged material as a result of contact with the recycled outer container 10. Thus, the second embodiment is advantageous because recycled plastic is generally less costly than virgin plastic and is beneficial to the environment.

The method according to the present invention for assembling the outer container 10 having a container insert 12 therein will now be described generally.

With reference to FIG. 2, the method comprises the initial steps of forming the outer container 10 and container insert 12. The container 10 and insert 12 are preferably formed by injection-blow molding, although other molding processes, such as extrusion blow molding or injection molding, may be used. To aid in the removal of the container insert 12 during the molding process, the exterior surface 44 of the container insert 12 includes a second groove 52 to provide a gripping surface. In addition, the lip 54 of the outer container 10 also provides a gripping surface to facilitate removal of the heated outer container 10 from the injection molding apparatus.

Next, the temperature of the container insert 12 is controlled such that the container insert 12 is at a first predetermined temperature. Preferably, the step of controlling the temperature of the container insert 12 comprises cooling the container insert 12 to the first predetermined temperature after it has been formed. This cooling may be effected by exposing the container insert 12 to air at ambient conditions or by refrigeration. It is preferred that the first predetermined temperature be ambient temperature, generally between 50° F. to 80° F., although one skilled in the art would understand that the first predetermined temperature may be any temperature which is less than the temperature of the container 12, as discussed below.

The temperature of the outer container 10 is controlled such that the outer container 10 is at a second predetermined temperature greater than the first predetermined temperature of the container insert 12. The elevated second temperature is achieved when the outer container 10 is removed from the injection molding apparatus, prior to significant cooling. Preferably, the second predetermined temperature is between 100° F. and 150° F. However, it is understood by those skilled in the art that the second predetermined temperature of the outer container 10 can be achieved by reheating the outer container 10 by other means, such as an oven (not shown), if the outer container 10 has cooled to a temperature below 100°.

When the outer container 10 is at the second predetermined temperature and the insert is at the first predetermined temperature, the container insert 12 is positioned through the opening 24 in the neck portion 22 into the interior container portion 20 of the outer container 10 such that the exterior surface 44 of the upper portion 42 is in facing relationship with the interior surface 26 of the neck portion 22. The first end 48 of the grooves 46 is in fluid communication with the atmosphere surrounding the outer container 10 and the second end 50 of the grooves 46 is in fluid communication with the interior container portion 20 for allowing fluid, such as air, to pass through the grooves 46 from the interior container portion 20 to the atmosphere, as best shogun in FIG. 3.

The outer container 10 is cooled to a third predetermined temperature less than the second predetermined temperature such that the interior surface 26 of the neck portion 22 contracts into engagement with the exterior surface 44 of the upper portion 42 of the container insert 12, whereby the container insert 12 is frictionally secured to the neck portion 22. As the outer container 10 contracts, the volume of the interior container portion 20 decreases causing air to pass through the grooves 46 to the surrounding atmosphere.

The method of packaging a predetermined volume of material, such as pills, liquids, or powders, by use of an outer container 10 having a container insert 12 therein will now be described generally.

The method generally comprises the initial step of determining a volume of material to be packaged. This determination need not involve the counting of individual portions of material, such as tablets. However, pharmaceutical products are preferably packaged by count. A number of closely packed individual portions of material, such as tablets, generally occupy a known volume even though there may be small gaps between the tablets. This known volume corresponds to the volume of material to be packaged. Where the material to be packaged is a fluid, such as a liquid or powder, the volume of the material to be packaged is directly ascertainable.

Next, the person who is packing the material selects an outer container 10 having a volume greater than the determined voluble of material to be packaged and a container insert 12 therein having an interior portion 40 of a predetermined volume from a group of outer containers 10 with container inserts 12 having predetermined volumes different than the volume of material to be packaged. Preferably, the step of selecting an outer container 10 comprises selecting an outer container 10 with a container insert 12 therein having an interior portion 40 of a predetermined volume which corresponds to the volume of material to be packaged. By choosing an appropriately sized container insert, the need for cushioning material, such as cotton, to fill the unoccupied volume of the container may be reduced or altogether eliminated without having different sized outer containers.

The material to be packaged is then inserted into the interior portion 40 of the container insert 12. Preferably, the step of inserting the material into the interior portion 40 comprises inserting a number of individual portions of material, such as tablets. However, a skilled artisan understands that a liquid or powdered material may be similarly packaged. After the material to be packaged is deposited into the container insert 12 the outer container is then sealed with a cap or the like.

Figure 6:
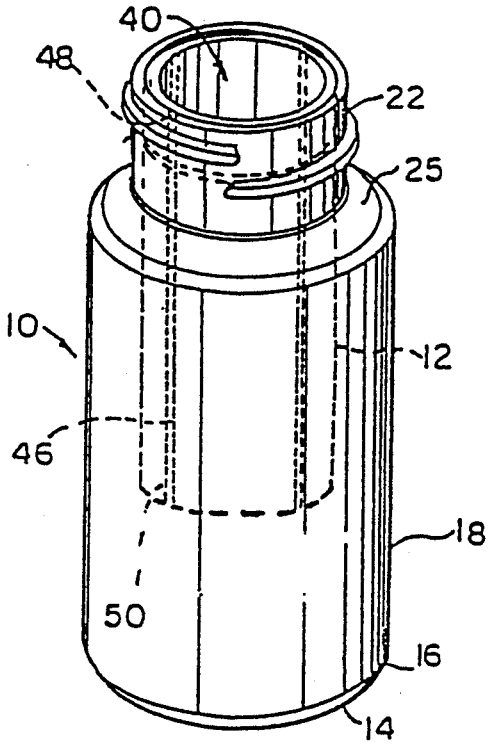
FIG. 6 is an elevational view, partially in cross section, of a second outer container having a second container insert therein, in accordance with a first embodiment of the present invention.

Using the foregoing method allows the manufacturer to have a small number of differently sized outer containers, wherein the outer containers have differently sized container inserts therein as shown in FIGS. 1 and 6. By reducing the number of different outer containers, automatic packaging processes are simple and efficient because the conveying system of the packaging equipment does not have to be reset each time a change in volume occurs. Moreover, the number of different shipping cartons and labels is significantly reduced.

It is understood by those skilled in the art that all of the aforementioned steps may be carried out by an individual person or automatically, as by a robotic assembly line.

From the foregoing description of the preferred embodiment, it can be seen that the present invention comprises an outer container having a container insert therein, a method for assembling the container insert within the outer container, and a method of packaging a predetermined volume of material using the aforementioned combination. It will be appreciated by those skilled in the art that changes could be made to the embodiment described above without departing from the broad inventive concept thereof. For instance, the present invention is not limited to the pharmaceutical industry and is useful in other industries which package different volumes of material, including confectionary and personal care products. It is understood, therefore, that this invention is not limited to the particular embodiment disclosed, but is intended to cover all modifications which are within the spirit and scope of the invention as defined by the appended claims.

We claim:

1. A method of packaging a predetermined volume of material comprising the steps of:

providing a plurality of substantially uniformly shaped and sized outer containers, each outer container comprising a container bottom having a periphery and a container wall extending generally upwardly from said periphery, said container bottom and said container wall defining an interior container portion having a first volume, said first volume being substantially uniform for each of said plurality of outer containers, said interior container portion being sized to accommodate a container insert, said container wall comprising a mouth defining an opening, said mouth having an interior surface including means for preventing removal of said insert;

providing a plurality of rigid first container inserts, each first container insert for being positioned within an interior container portion of one of said plurality of outer containers, each first container insert comprising a bottom having a periphery and a wall extending generally upwardly from said periphery, said bottom and said wall of each first insert defining an interior portion having a second volume, said second volume being less than said first volume, said wall of said first insert comprising an upper portion spaced apart from said bottom, said upper portion having an exterior surface dimensioned for complementary engagement with said interior surface of said mouth;

positioning one of said first container inserts within the interior container portion of one of said outer containers while venting gas from the interior container portion of said one outer container to atmosphere through a vent in one of said outer container and first container insert such that said interior container portion is entirely filled with a gas between said outer container and said first container insert and said gas can pass to and from said interior container portion through said vent;

providing a plurality of rigid second container inserts, each second container insert for being positioned within an interior container portion of one of said plurality of outer containers, each second container insert comprising a bottom having a periphery and a wall extending generally upwardly from said periphery, said bottom and said wall of each second insert defining an interior portion having a third volume, said third volume being less than said second volume, said wall of said second insert comprising an upper portion spaced apart from said bottom, said upper portion having an exterior surface dimensioned for complementary engagement with said interior surface of said mouth;

positioning one of said second container inserts within the interior container portion of one of said outer containers while venting gas from the interior container portion of said one outer container to atmosphere through a vent in one of said outer container and second container insert such that said interior container portion is entirely filled with a gas between said outer container and said second container insert and said gas can pass to and from said interior container portion through said vent;

selecting a first volume of material to be packaged which corresponds to said second volume;

inserting said first volume of material into said interior portion of one of said first container inserts positioned within one of said outer containers;

selecting a second volume of material to be packaged which corresponds to said third volume; and inserting said second volume of material into said interior portion of one of said second container inserts positioned within one of said outer containers.

* * * * *